US006267305B1

(12) United States Patent
Kondo

(10) Patent No.: US 6,267,305 B1
(45) Date of Patent: Jul. 31, 2001

(54) SHOWER HEAD

(75) Inventor: Kazuhiro Kondo, Niigata-ken (JP)

(73) Assignee: Hiroyuki Ehara, Niigata-ken (JP)

( * ) Notice: Subject to any disclaimer, the term of this patent is extended or adjusted under 35 U.S.C. 154(b) by 0 days.

(21) Appl. No.: 09/524,127

(22) Filed: Mar. 13, 2000

(30) Foreign Application Priority Data

Nov. 4, 1999 (JP) ..... 11-350635

(51) Int. Cl.[7] ..... B05B 1/18
(52) U.S. Cl. ..... 239/428.5
(58) Field of Search ..... 239/428.5; 15/29, 15/97.1; 401/268, 203

(56) References Cited

U.S. PATENT DOCUMENTS 2,247,311 * 6/1941 Rockwood ..... 239/428.5
4,135,670 * 1/1979 Sugimoto ..... 239/428.5
4,629,124 * 12/1986 Gruber ..... 239/428.5
4,733,818 * 3/1988 Aghnides ..... 239/428.5
5,109,553 * 5/1992 Kishimoto ..... 239/428.5

FOREIGN PATENT DOCUMENTS

2068778 * 8/1981 (GB) ..... 239/428.5
9-187391 7/1997 (JP) .
10-43641 2/1998 (JP) .

* cited by examiner

*Primary Examiner*—Lesley D. Morris
(74) *Attorney, Agent, or Firm*—Christensen O'Connor Johnson Kindness PLLC

(57) ABSTRACT

A shower head comprises a jet nozzle for jetting pressurized water supplied, a shower main body having ejector mechanisms consisting of the jet nozzle and an air-liquid mixing tube provided via an air suction member, a discharge outlet of the air-liquid mixing tube opening to a shower discharge member, and an annular projecting member projecting from the shower discharge member so as to surround the discharge outlet, wherein an air absorption hole of the air absorption member is made in an outer side section of the annular projecting member.

13 Claims, 7 Drawing Sheets

SHOWER HEAD

CROSS-REFERENCE TO RELATED APPLICATION

This application is based upon and claims the benefit of priority from the prior Japanese Patent Application No. 11-350635, filed Nov. 4, 1999, the entire contents of which are incorporated herein by reference.

BACKGROUND OF THE INVENTION

The present invention relates to a shower head having a high cleaning power, capable of saving water, and further being user-friendly.

Shower heads are widely used, for example, in households, for bathing or washing a car or the like, and industrially, in washing shower devices and the like. In these shower heads, a shower main body is equipped with a shower discharge section in which a great number of pressurized water spraying pores each having a small diameter are made. As a great number of string-like water jets sprayed from the shower head are made to collide on a surface to be washed, attached stains are peeled off or dissolved to be cleaned.

With the above-described structure, the cleaning power depends mostly on the impact power of the water jets and the amount of water applied. Therefore, in order to obtain a sufficient cleaning power, a great amount of high-pressure running water is required, due to which an advantage of saving water cannot be expected.

BRIEF SUMMARY OF THE INVENTION

The object of the present invention is to provide a shower head having a strong cleaning power and capable of saving water, which can be achieved by applying ultrasonic vibration to the shower head.

According to the present invention, a water stream jetted at high speed from a jet nozzle to an air absorption member tangles surrounding air into itself, and they are mixed together in an air-liquid mixing pipe. Then, the mixture is discharged from a discharge outlet. During this operation, a space created by the surface to be washed, an inner wall of an annular projecting member, and a shower discharge member, serves as a washing tub in a pseudo manner, and the air-liquid mixed water jet discharged in the pseudo tub is retained while making vortex.

Therefore, on the surface to be washed, the impact force made by the collision of air-liquid mixed water jets discharged from the discharge outlet, a stirring force made by the strong vortex within the pseudo washing tub, and further ultrasonic vibration generated when bubbles mixed in the water decompose, are applied, thus creating a strong cleaning power. Further, the substantial amount of water is decreased due to the bubbles which mix in, and the cleaning time is shortened due to the strong cleaning power. Therefore, it becomes possible to significantly reduce the substantial amount of water used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
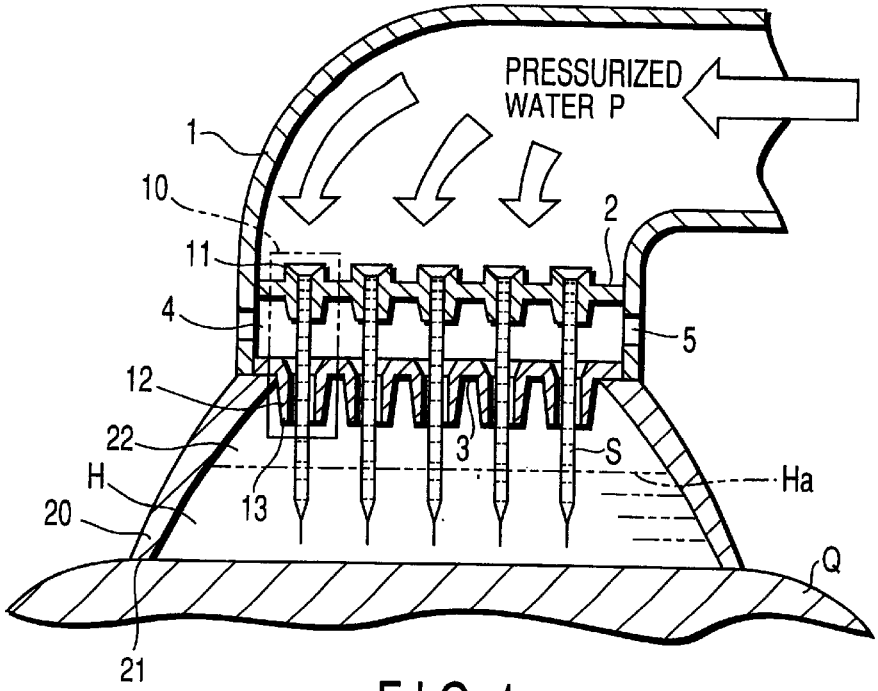
FIG. 1 is a cross sectional view of a shower head according to the first embodiment of the present invention.

FIG. 1 is a cross sectional view of a shower head according to the first embodiment of the present invention, and this figure shows a shower main body 1. In a distal portion of the shower main body 1, a jet nozzle support plate 2 for supporting a jet nozzle 11, a shower discharge portion 3, and an air absorption section 4 provided between the jet nozzle support plate 2 and the shower discharge portion 3 are formed. Further, at a position corresponding to the air absorption section 4 of the shower main body 1, an air absorption path 5 which communicates the inside and outside of the shower main body 1 is formed.

The air suction hole of the air absorption path 5 is outside a space defined within the annular projecting member.

An ejector mechanism 10 consists of a jet nozzle 11 formed in a jet nozzle support plate 2, an air-liquid mixing tube 12 formed in the shower discharge portion 3 and an air absorption section 4. It should be noted here that a discharge outlet 13 is made in the distal end side of the air-liquid mixing tube 12.

An inner diameter of the air-liquid mixing tube 12 is made larger than the nozzle diameter of the jet nozzle 11, and these members are arranged to be substantially coaxial.

An annular projecting member 20 is detachably mounted on the distal end of the main body 1, and the edge of the distal end of the annular projecting member 20 projects out so as to surround the discharge outlet 13. The edge 21 of the end of the annular projecting member 20 further projects out from the discharge outlet 13.

In the case where pressurized water P is applied onto the above-described structure, water jets supplied to the air absorption section 4 by each jet nozzle 11 pass straight through air-liquid mixing tubes 12, and the jets becomes string-like water jets S which do not substantially contain bubbles, to be then discharged, as shown in FIG. 1. In other words, although the diameter of each jet is larger and the number of jets is smaller that those of the conventional shower head, such a shower head can be used with similar advantages of the conventional shower head.

Figure 2:
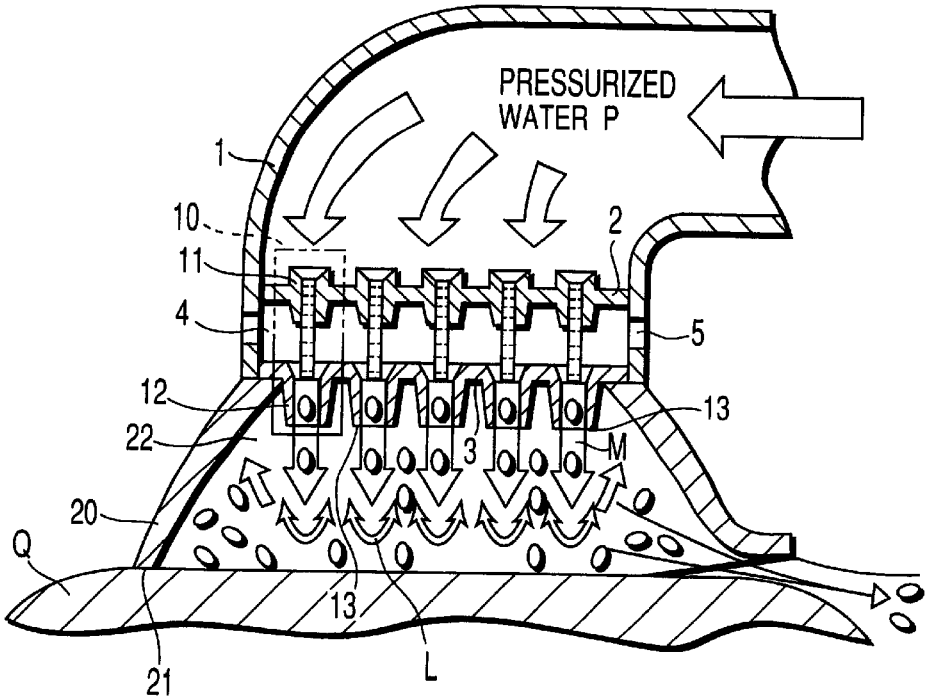
FIG. 2 is a cross sectional view showing a state in which air-liquid mixed water jets are discharged in the pseudo washing tub in the shower head.

Further from the above-described state, the main body 1 is made closer to a surface Q to be washed, and the edge of the end of the annular projecting member is brought into contact with the surface Q. Thus, the string-like water jets S discharged start to fill in a pseudo washing tub 22 defined by the surface Q to be washed, the inner wall of the annular projecting member 20 and the shower discharge portion 3. When the surface Ha of the reserved water reaches a position where the discharge outlet is covered by the water, the air and water starts to mix, and the string-like water jets S are transformed into the string-like air-liquid mixed water jets M. Then, instantaneously, air-liquid mixed water fluid L is generated in the form of strong vortex within the entire pseudo washing tub 22, as shown in FIG. 2.

In this manner, on the surface Q to be washed, which creates a bottom surface of the pseudo washing tub 22, the impact force made by the direct collision of the string-like air-liquid mixed water jets M discharged from the discharge outlet 13, the stirring force made by the strong vortex, and further the ultrasonic vibration generated when bubbles mixed in the water decompose, are applied, thus creating a strong cleaning power.

After that, the air-liquid mixed water fluid L which is temporarily contained in the pseudo washing tub 22 is discharged through a gap created at the contact section between the edge 21 of the end of the annular projecting member and the surface Q to be washed, together with stain components peeled off or dissolved.

When the edge 21 of the end of the annular projecting member 20 is made of an elastic material such as silicon rubber, waste water can be discarded by pushing the gap with respect to the surface Q to be washed appropriately to open it with a discarding pressure of the air-liquid mixed water fluid L, which is advantageous.

Further, since the annular projecting member 20 is made to be detachable, the projecting member 20 itself can be replaced with some other type in accordance with the type of an object to be washed, thus increasing the convenience.

The mechanism in which the mixing of air and water is immediately started, will now be described in further detail. That is, in general, when a high-speed water jet is sprayed into the atmosphere, a negative pressure is created between the surface of the high-speed water jet and the atmosphere. However, if the edge 21 of the end of the annular projecting member 20 and the surface Q to be washed are fully distant away from each other, the discharge outlet 13 and the atmosphere are communicated with each other, and the negative pressure within the air-liquid mixing tube 12 is released. Thus, the air and water jets are separated from each other, and the water jets are discharged as string-like water jets S similar to those of the conventional shower head.

On the other hand, as the edge 21 of the end of the annular projecting unit is brought into contact with the surface to be washed, string-like water jets S discharged start to gather. When the surface Ha of the reserved water has reached a position where the discharge outlet is covered by the water, the communication between the atmosphere and the discharge outlet 13 is disconnected, thus generating a large negative pressure instantaneously within the air-liquid mixing tube 12.

Due to the negative pressure, water jets are broken into fine particles, and air is absorbed in gaps made between fine particles, thus creating the string-like air-liquid mixing water jets M to be discharged. Here, when the distance between the edge of the end of the annular projecting member and the surface Q to be washed is increased gradually from the above-described state, the mixing of the air and water stops at a point when the surface Ha of the reserved water H releases the covering of the discharge outlet 13, thus transforming the water into string-like water jets S.

With the embodiment described above, a strong cleaning power can be generated, and at the same time, the net amount of water can be decreased by mixing air into water, and the cleaning time can be shortened due to the strong cleaning power. In this manner, it becomes possible to save a great amount of water actually used.

Figure 3:
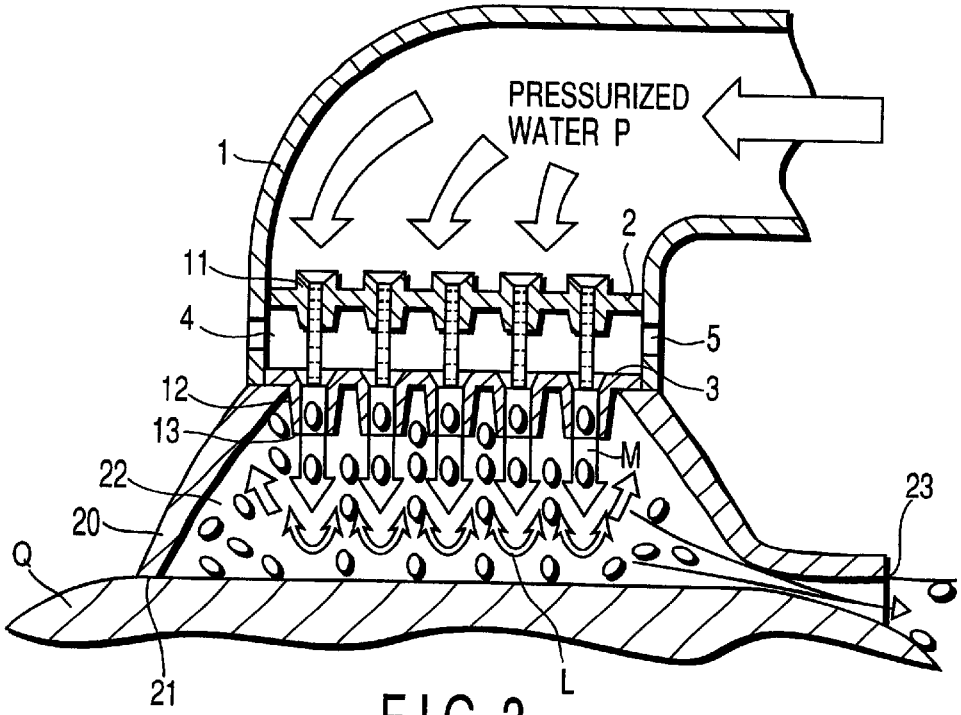
FIG. 3 is a cross sectional view of a shower head according to the second embodiment of the present invention.

FIG. 3 is a cross sectional view showing a shower head according to the second embodiment of the present invention. In FIG. 3, the same structural elements as those shown in FIGS. 1 and 2 are designated by the same reference numerals, and the explanations therefore will not be repeated. A drain path 23 is formed in a section of the edge 21 of the end of the annular projecting member 20. With this structure, water to be discarded, which contains stain components peeled off or dissolved, is discarded via the drain path 23 after the cleaning operation. In this manner, it is possible to obtain the same advantage as that of the shower head of the first embodiment, and further, it becomes possible to arbitrarily set the location and direction of discarding water. Therefore, the drain path can be arranged as desired so as to improve the usability of the shower head.

Figure 4:
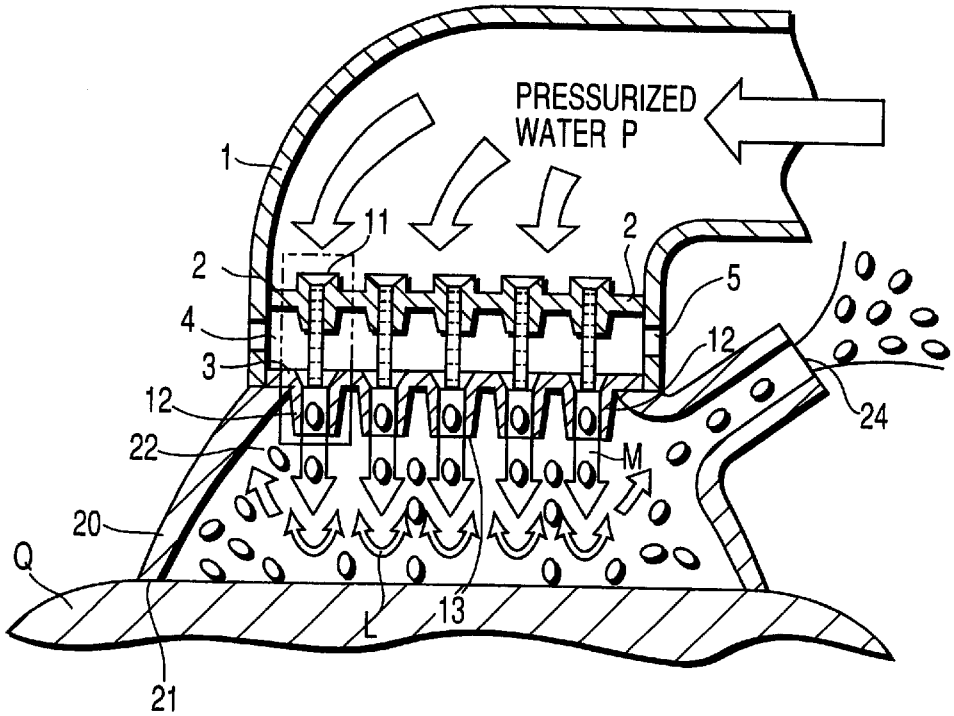
FIG. 4 is a cross sectional view of a shower head according to the third embodiment of the present invention.

FIG. 4 is a cross sectional view of a shower head according to the third embodiment of the present invention. In this embodiment, an outside air communication hole 24 is made in the annular projecting member 20. With this embodiment, it is possible to obtain the same advantage as that of the shower head of the second embodiment.

Figure 5:
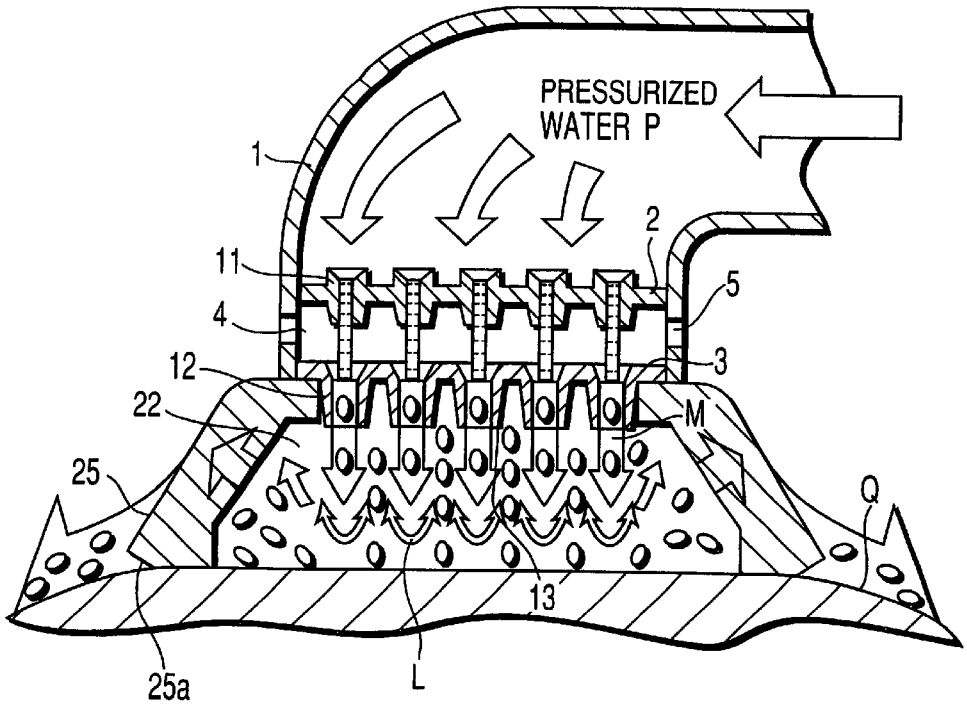
FIG. 5 is a cross sectional view of a shower head according to the fourth embodiment of the present invention.

FIG. 5 is a cross sectional view of a shower head according to the fourth embodiment of the present invention. In FIG. 5, an annular projecting member 25 made of a water-permeating material such as sponge is used in place of the annular projecting member 20 used before. With this embodiment, it is possible to obtain the same advantage as that of the shower head of the second embodiment, and at the same time, it is possible to scrub the surface Q to be washed, with the edge 25*a* of the end of the annular projecting member while discarding water from the outer wall surface of the annular projecting member 25. In this manner, a further cleaning effect can be expected, and thus the embodiment is appropriate for shower heads used for bathing, washing face or washing automobiles.

Figure 6:
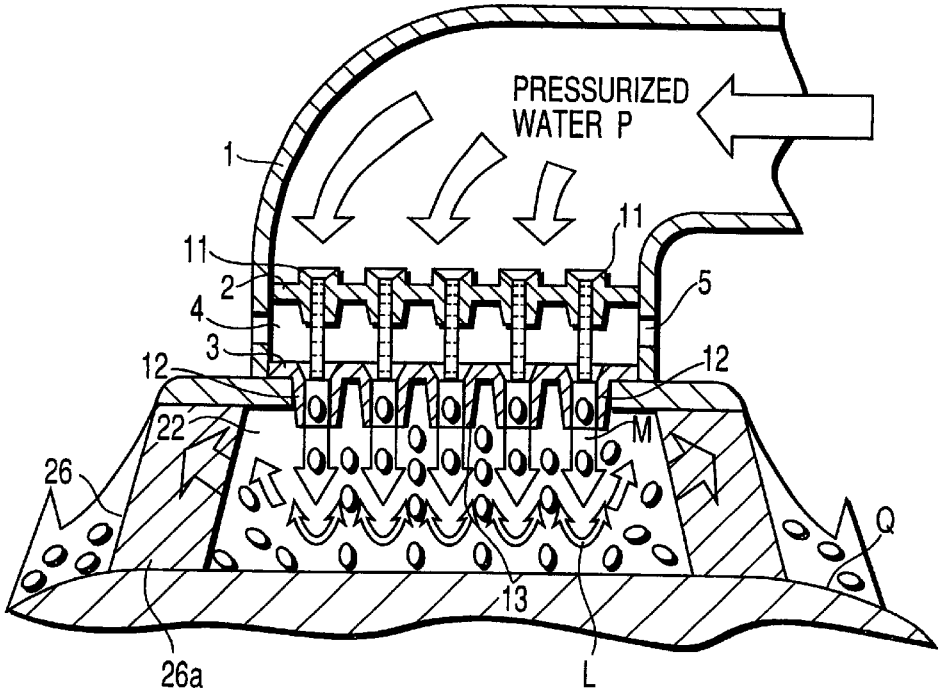
FIG. 6 is a cross sectional view of a shower head according to the fifth embodiment of the present invention.

FIG. 6 is a cross sectional view of a shower head according to the fifth embodiment of the present invention. In FIG. 6, an annular projecting member 26 formed to be dense brush is used in place of the annular projecting member 20 used before. With this embodiment, it is possible to obtain the same advantage as that of the shower head of the second embodiment, and at the same time, it is possible to scrub the surface Q to be washed, with the edge 26*a* of the end of the annular projecting member while discarding water from the outer wall surface of the annular projecting member 26.

Figure 7:
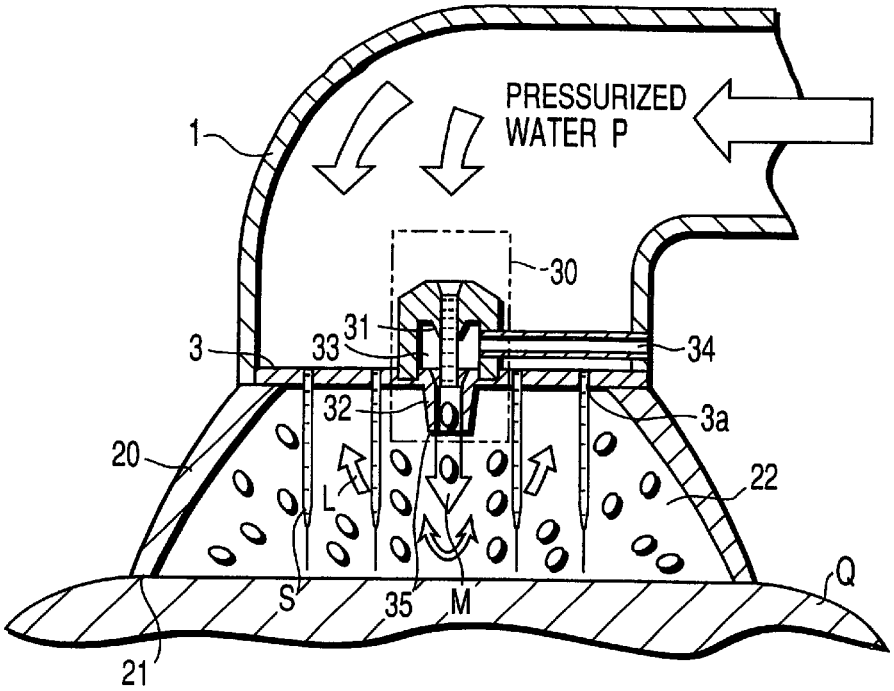
FIG. 7 is a cross sectional view of a shower head according to the sixth embodiment of the present invention.

FIG. 7 is a cross sectional view of a shower head according to the sixth embodiment of the present invention. In a distal portion of the shower main body 1, a shower discharge portion 3 is provided, and pressurized water jet holes 3*a* each having a small diameter are made in the shower discharge portion.

The figure illustrates an ejector mechanism 30. The ejector mechanism 30 consists of a jet nozzle 31, an air-liquid mixing tube 32 formed in the shower discharge portion 3, an air absorption portion 33 formed between the jet nozzle 31 and the air-liquid mixing tube 32, and an air absorption pipe 34 which communicates the air absorption section 33 and the outside of the main body 1. It should be noted here that a discharge outlet 35 is made in the distal end side of the air-liquid mixing tube 32. The air suction hole of the air absorption pipe 34 is made in an outer side section of the annular projecting member.

In this embodiment, pressurized water P is supplied to both the jet nozzle 31 of the ejector mechanism 30 and each pressurized water jet hole 3*a*. From the shower discharge portion 3, the string-like air-liquid mixed water jets M and the string-like water jets S are discharged into the pseudo washing tub 22.

When the edge 21 of the end of the annular projecting portion and the surface Q to be washed are separated from the above-described state, the string-like air-liquid mixed water jets M discharged from the air-liquid mixing tube 32 is transformed into string-like water jets S, which slip into the other string-like water jets S discharged from the pressurized water jet holes 3*a*. With this structure, the functions of both the conventional shower head and the shower head of the present invention can be used, and therefore the present invention can be used by a user who is used to the conventional shower head without having a sense of strangeness.

Figure 8:
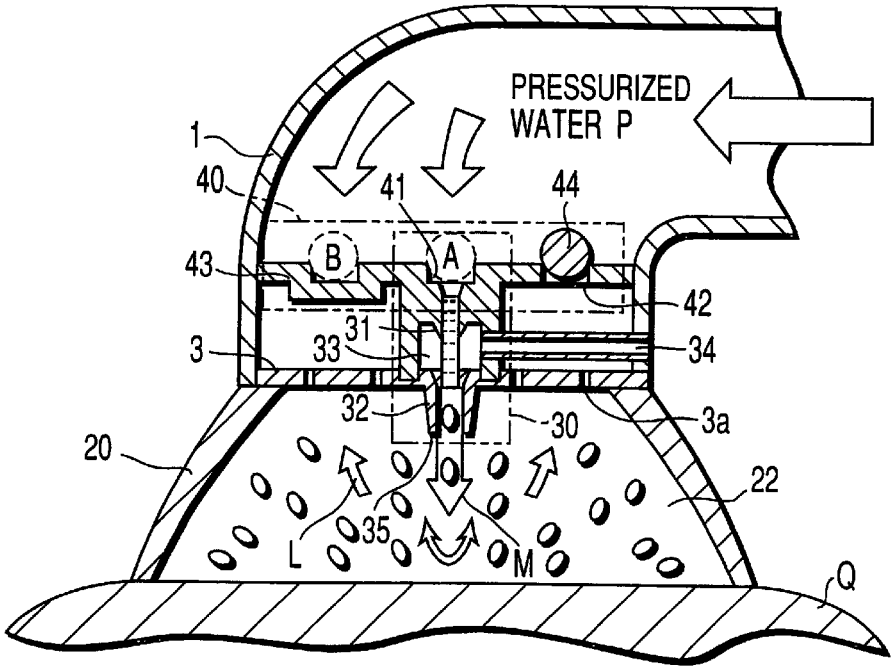
FIG. 8 is a cross sectional view of a shower head according to the seventh embodiment of the present invention.

FIG. 8 is a cross sectional view of a shower head according to the seventh embodiment of the present invention. This embodiment is obtained by adding a pressurized water supply path switching mechanism 40 to the sixth embodiment.

The pressurized water supply path switching mechanism 40 has a cover wall 43 having through holes 41 and 42, and a ball valve 44 for covering either one of the through holes 41 and 42.

When the ball valve 44 is moved to a position indicated in FIG. 8, the pressurized water P is supplied only to the jet nozzle 31 of the ejector mechanism 30, and therefore only the string-like air-liquid mixing water jets M is discharged into the pseudo washing tub 22.

When the ball valve 44 is at a position A in FIG. 8, pressurized water is supplied only to the pressurized water jet holes 3*a*. Therefore, the shower head can be used as the conventional type.

Further, when the ball valve 44 is moved to a position B in the figure, the pressurized water P is supplied to both the jet nozzle 31 of the ejector mechanism 30 and the pressurized water jet holes 3*a*, thus creating the same state as that of the sixth embodiment.

With the above-described structure, the functions of the conventional type of a shower head and the shower head of the present invention can be switched over in accordance with the preference of the user, thus improving the usability and convenience.

Figure 9:
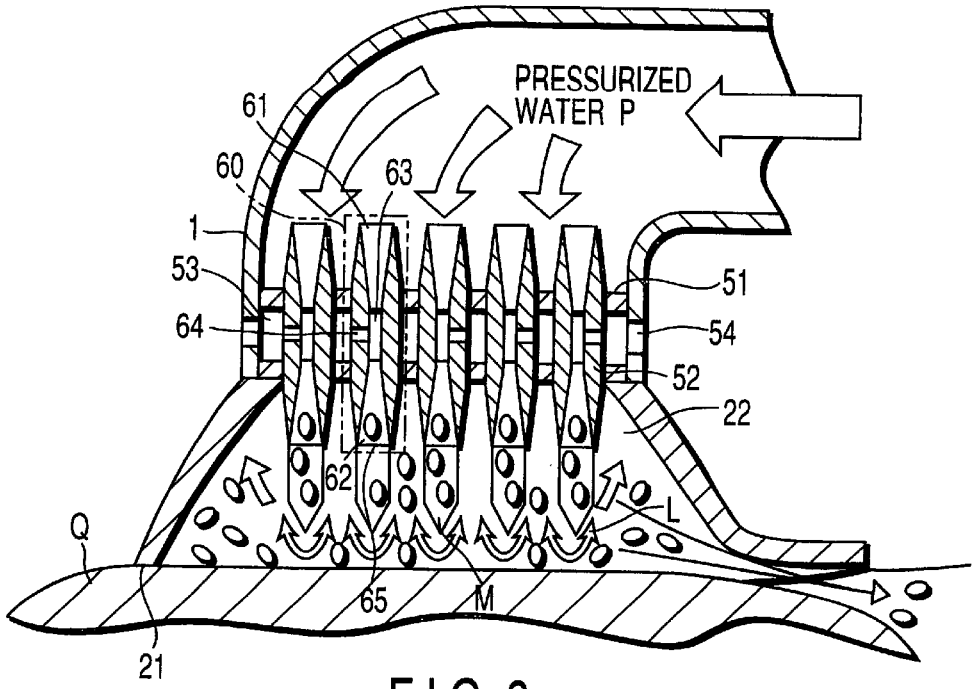
FIG. 9 is a cross sectional view of a shower head according to the eighth embodiment of the present invention.

FIG. 9 is a cross sectional view of a shower head according to the eighth embodiment of the present invention. The same structural elements of FIG. 9 as those shown in FIG. 1 are designated by the same reference numerals, and the detailed explanations therefor will be omitted.

In a distal portion of the main body 1, a Venturi mechanism supporting plate 51 for supporting a Venturi mechanism 60, which will be later explained, a shower discharge portion 52 and a space section 53 situated between the Venturi mechanism supporting plate 51 and the shower discharge portion 52, are formed. Further, at a position corresponding to the space section 53 of the main body 1, an air absorption path 54 which communicates the inside and outside of the main body 1 with each other, is formed.

The air suction hole of the air absorption path 54 is located outside a space defined within the annular projecting member.

The Venturi mechanism 60 consists of a tapered tube portion 61, a widening tube portion 62 and a throat portion 63, which is a portion having the minimum cross sectional area. Further, in the throat portion 63, air suction holes 64 which communicate with the space section 53 are formed. It should be noted that a discharge outlet 65 is formed at the distal end side of each widening tube portion 62.

In the case where the pressurized water P is supplied in the above-described structure, when the pressurized water P flowing into the Venturi mechanism 60 reaches the throat portion 63, the static pressure decreases by the Bernoulli's theorem. Therefore, atmospheric air is suctioned via the absorption path 54 and the air suction holes 64, and air is absorbed into water in the widening tube portion 62 in the form of bubbles. After that, the water is discharged from the discharge outlet 65 as string-like air-liquid mixed water jets M.

Then, the main body 1 is set closer to the surface to be washed Q from this state and the edge 21 of the end of the annular projecting member is brought into contact with the surface Q to be washed. Thus, the fluid of the string-like air-liquid mixed water jets M discharged as shown in FIG. 9 fills in the pseudo washing tub 22 formed by the surface Q to be washed, the inner wall of the annular projecting member 20, and the shower discharge portion 52, and an air-liquid mixed water fluid L creates a strong vortex within the entire pseudo washing tub 22.

In this manner, on the surface Q to be washed, which creates a bottom surface of the pseudo washing tub 22, the impact force made by the direct collision of the string-like air-liquid mixed water jets M discharged from the discharge outlet 65, the stirring force made by the strong vortex of the air-liquid mixed water fluid L contained in the pseudo washing tub 22, and further the ultrasonic vibration generated when bubbles mixed in the water decompose, are applied, thus creating a strong cleaning power.

Figure 10:
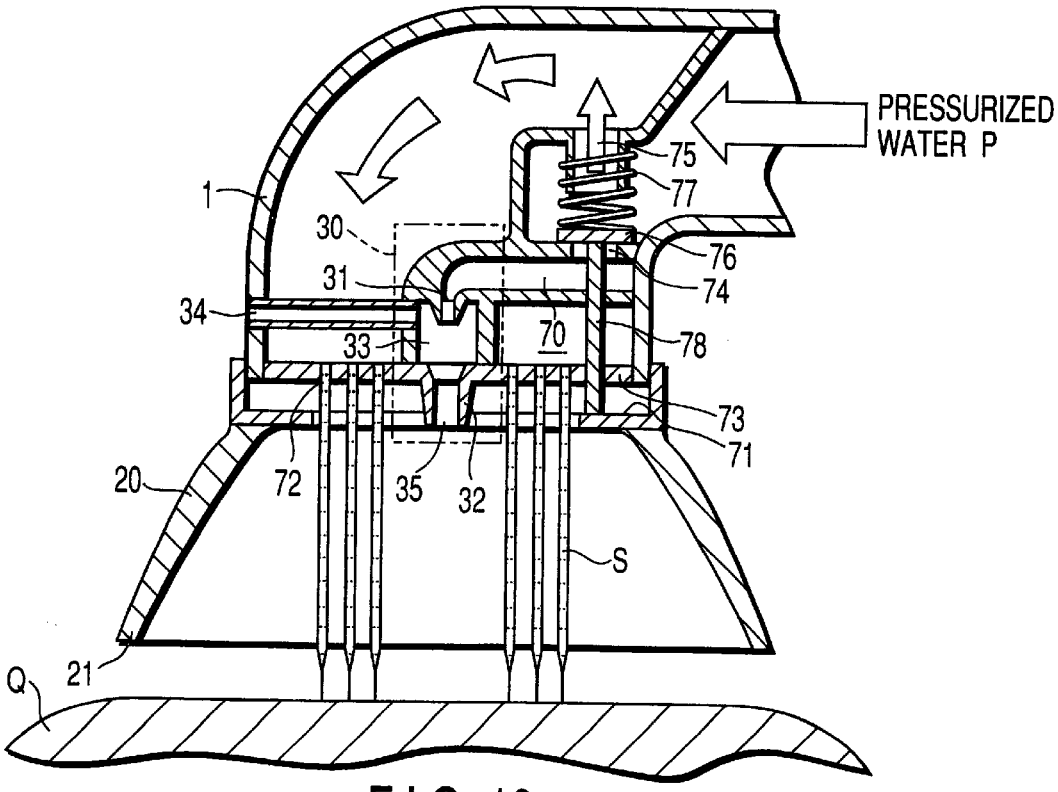
FIG. 10 is a cross sectional view of a shower head according to the ninth embodiment of the present invention.
Figure 11:
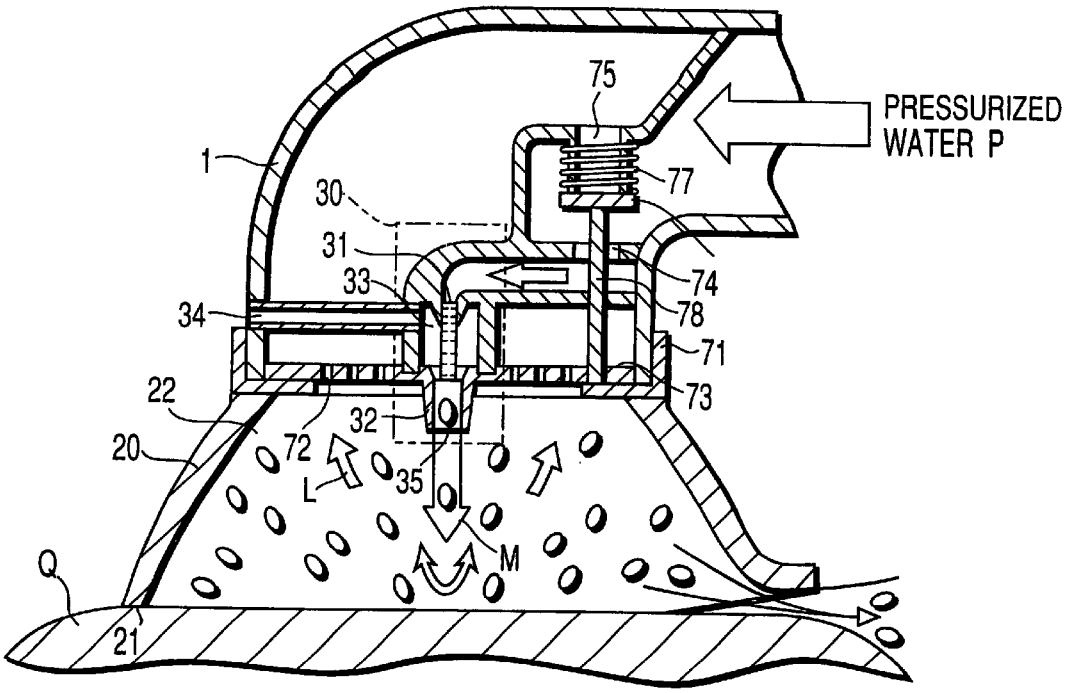
FIG. 11 is a cross sectional view of the shower head shown in FIG. 10 in a state in which a tip end edge of the annular projecting member is brought into contact with a surface to be washed.

FIGS. 10 and 11 are cross sections showing a shower head according to the ninth embodiment of the present invention.

At a distal end side of the main body 1, a shower switching mechanism 70 is provided. The shower switching mechanism 70 consists of an annular projecting member support plate 71, provided to be slidable with respect to the main body 1, for supporting an annular projecting member 20, and a shower discharge portion 73 mounted on the distal end of the main body 1 and having pressurized water jet holes 72. The main body 1 is partitioned into a jet nozzle tube path 74 and a pressurized water jet hole tube path 75, and the pressurized water jet hole path 75 is designed to be opened/closed with a stopper valve 76.

Further, the stopper valve 76 is equipped with a compression spring 77 and a stopper valve rod 78, and as it is urged downwards in the figure by the compression spring 77, the jet nozzle tube path 74 and the pressurized water P are shut. The lower end (as it is seen in the figure) of the stopper rod 78 is brought into contact with the annular projecting member support plate 71. That is, as the edge 21 of the end of the annular projecting member is brought into contact with the surface Q to be washed, the annular projecting member support plate 71 is moved upwards via the annular projecting member 20. Accordingly, the stopper rod 78 is moved upwards in the figure. In this manner, the stopper valve 76 has the function of closing the pressurized water jet hole path 75.

In the embodiment having the above-described structure, when the pressurized water P is supplied, the water P reaches the shower discharge portion 73 via the pressurized water jet hole path 75. From the pressurized water jet holes 72, which the water is jetted as string-like water jets S, and thus the embodiment functions as an ordinary shower head.

After that, as the edge 21 of the annular projecting member is pressed on the surface Q, the annular projecting member 20 and the annular projecting member support plate 71 make an integral unit as shown in FIG. 11, and it moves upwards in the figure. Accordingly, as the stopper valve rod 78 is moved upwards in the figure, the stopper valve 76 is pushed up while contracting the compression spring 77.

Thus, when the pressurized water jet hole path 75 is closed in this manner, the pressurized water is jetted from the jet nozzle 31 to the air absorption portion 33 via the jet nozzle tube path 74, and the water starts to fill in the pseudo washing tub 22 formed by the surface Q to be washed, the inner wall of the annular projecting member 20 and the shower discharge portion 73.

After that, from the point when the surface of the reserved water reaches the position where the discharge outlet 35 is covered, surrounding air is absorbed into the water while intertwining them with each other, and thus the air and water are mixed together in the air-liquid mixing tube 32, to be then discharged. In this manner, the air-liquid mixed water fluid L creates a strong vortex instantaneously in the entire pseudo washing tub 22. Then, the water is discarded from the gap between the edge 21 of the end of the annular projecting member and the surface Q, together with stain components peeled off or dissolved.

When the edge 21 of the end of the annular projecting member is separated from the surface Q, that is, when washing is aborted, an operation reverse to the above is carried out, the jet nozzle tube path 74 is closed, and the pressurized water jet hole path 75 is released. Therefore, string-like water jets S are output from the pressurized water jet holes 72, thus the operation shifts back to the ordinary shower head.

With the shower head according to the embodiment, the same advantage as that of the first embodiment can be obtained. In addition, pressurized water P is not jetted from the jet nozzle even if pressurized water P is supplied while the edge of the end of the annular projecting member is not in contact with the surface to be washed. With this structure, unexpected jetting of pressurized water P can be prevented when there is no intention of washing an object to be washed, thus making it possible to avoid wetting or staining surroundings. Therefore, it becomes possible to provide a highly usable shower head having a strong cleaning power and capable of saving water.

Figure 12:
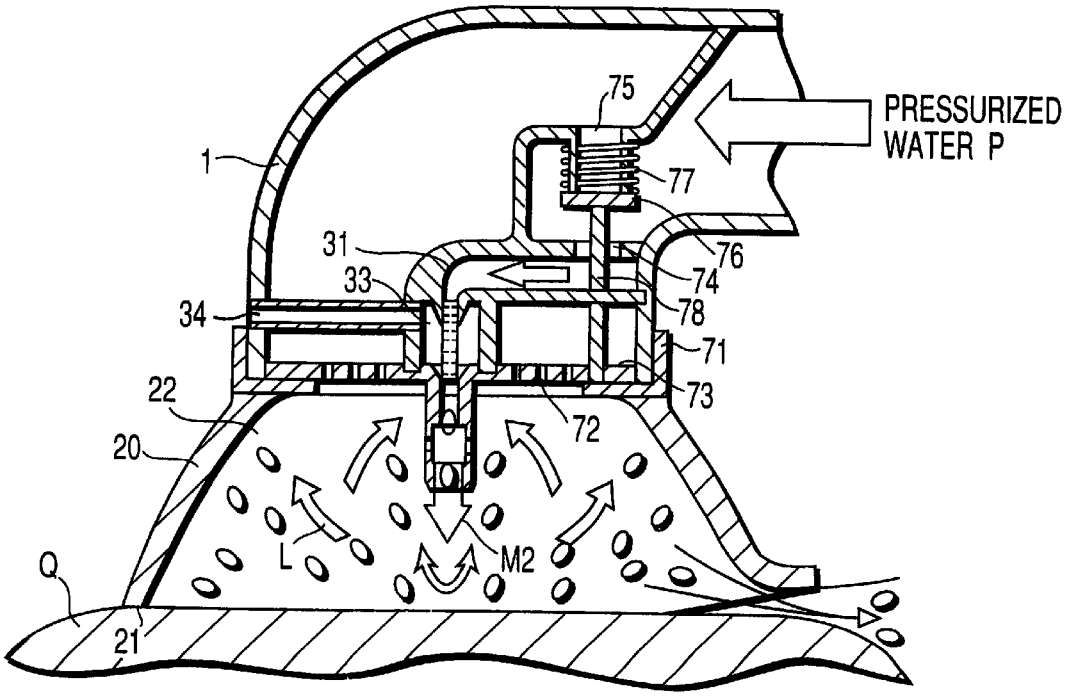
FIG. 12 is a cross sectional view of a shower head according to the tenth embodiment of the present invention.
Figure 13:
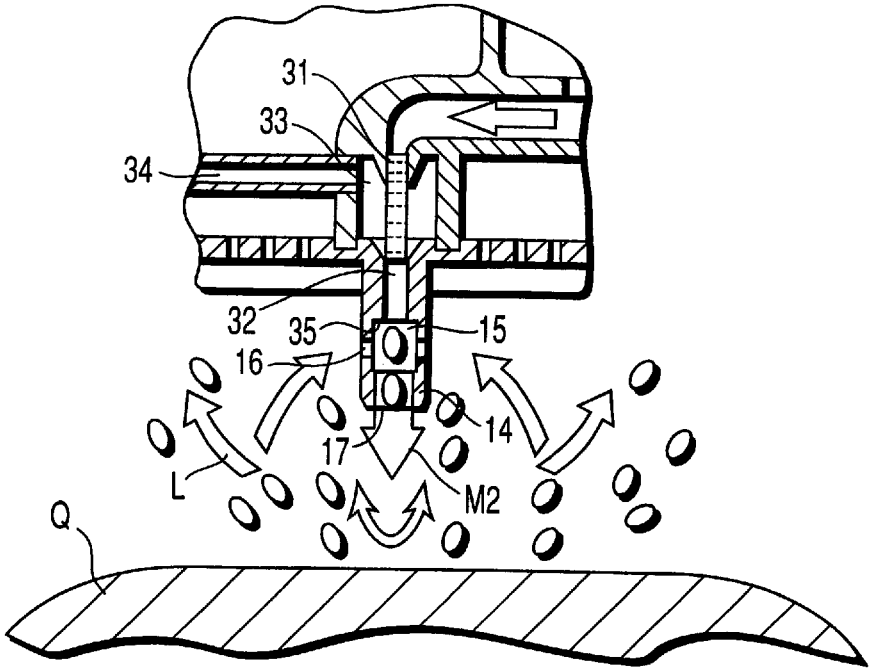
FIG. 13 is an enlarged cross sectional view of the shower head shown in FIG. 12, designed to explain the vicinity of a second space portion.

FIGS. 12 and 13 are cross sectional views of a shower head according to the tenth embodiment of the present invention.

At the distal end side of the air-liquid mixing tube 32, a second air-liquid mixing tube 14 is mounted via a second space section 15. An inner diameter of the second air-liquid mixing tube 14 is larger than an inner diameter of the air-liquid mixing tube 32. Further, the second space section 15 is communicated with the outside via a second fluid suction portion 16. Further, a second outlet 17 is formed in a distal end of the second air-liquid mixing tube 14.

With the above-described structure, when the edge 21 of the end of the annular projecting member 20 is pressed on the surface Q to be washed, pressurized water P is jetted from an air absorption portion 33 from a jet nozzle 31 via a jet nozzle tube path 74. Jets of discharged water pass straight through the air-liquid mixing tube 32, the second space section 15 and the second air-liquid mixing tube 14, and start to fill in a pseudo washing tub 22 formed by the surface Q, the inner wall of the annular projecting member 20 and the shower discharge portion 73. Then, from the point when the surface of the reserved water reaches a position where the second discharge outlet 17 is covered, the absorption of air in the pseudo washing tub 22 starts via the second fluid suction portion 16.

Consequently, the inside of the pseudo washing tub 22 will have a negative pressure with respect to the atmosphere. Further, as the amount of water discarded decreases, the filling rate of the discharged water into the pseudo washing tub 22 is increased.

After that, from the point when the surface of the reserved water reaches a position where the second fluid suction portion 16 is covered, the fluid to be suctioned shifts from air to reserved water. Then, a strong compulsory convection is generated in the pseudo washing tub 22 from the second discharge outlet 17 to the second fluid suction portion 16. At the same time, the discharge outlet 35 of the air-liquid mixing tube 32 is blocked by a water stream, and therefore air is suctioned via the air absorption pipe 34 into the air absorption portion 33, and air is mixed into the water in the air-liquid mixing tube 32, then to be discharged.

In this manner, air-liquid mixed water jets M discharged from the air-liquid mixing tube 32 and reserved water suctioned from the second fluid suction portion 16 flow into the second air-liquid mixing tube 14, to be mixed together. Then, the mixed water is discharged into the pseudo washing tub 22 as second air-liquid mixed water jets M2 from the second discharge outlet 17.

Thus, the air suctioned into the air absorption portion 33 is decomposed into finer bubbles, which combine with the strong compulsory convection flowing from the second discharge outlet 17 to the second fluid suction portion 16. Thus, it is possible to achieve a strong cleaning power for a soft impact force.

With the shower head according to this embodiment, the same advantage as that of the ninth embodiment can be obtained. In addition, the filling rate of the discharged water into the pseudo washing tub can be increased. Further, the stirring and circulation within the pseudo washing tub are promoted, and suctioned bubbles are made finer. Thus, it is possible to reinforce the cleaning power for a softer impact force.

Figure 14:
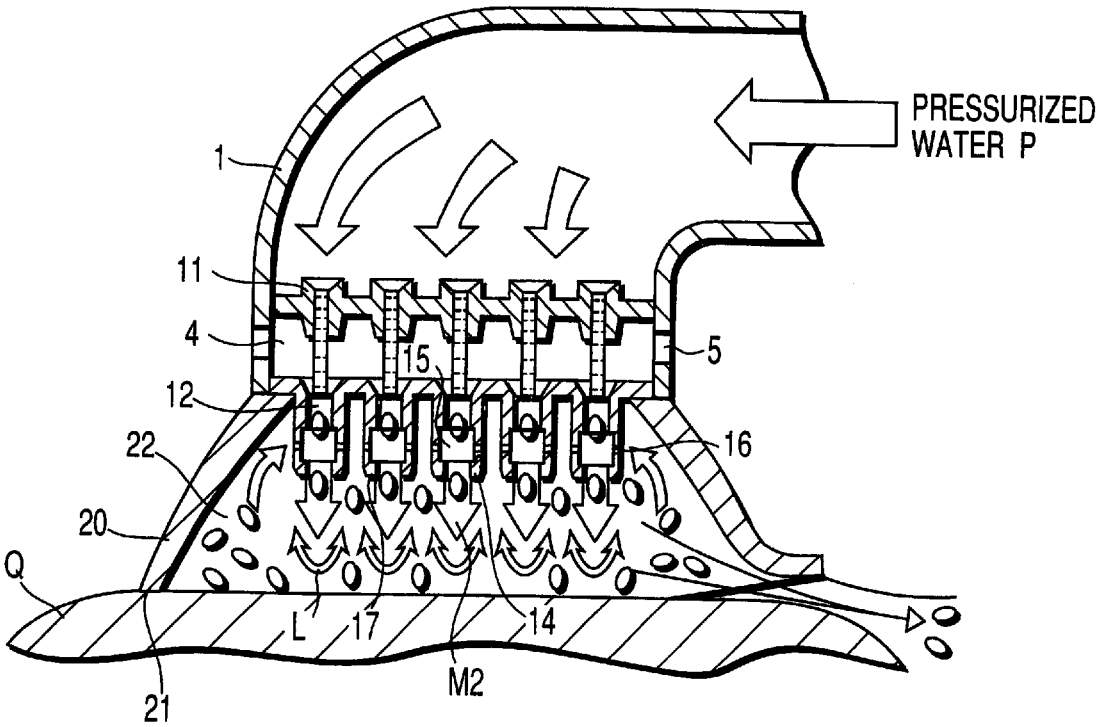
FIG. 14 is a cross sectional view of a shower head according to the eleventh embodiment of the present invention.

FIG. 14 is a cross sectional view of a shower head according to the eleventh embodiment of the present invention. In this embodiment, a second space section 15, a second fluid suction portion 16 and a second air-liquid mixing tube 14 are provided for a distal end of the air-liquid mixing tube 12 of the first embodiment described above.

Thus, the same advantage as that of the first embodiment can be obtained. In addition, the filling rate of the discharged water into the pseudo washing tub 22 can be increased. Further, a strong compulsory convection is created, and bubbles are made finer. Thus, it is possible to reinforce the cleaning power for a softer impact force.

It should be noted that the present invention is not limited to the above-described embodiments. More specifically, when a water purification cartridge having a function of removing free chlorine in pressurized water P supplied, is provided, and the cartridge is equipped with dechlorination agent such as ion exchange resin, activated carbon fiber, coral sand and alloy medium, free chlorine in tap water supplied can be removed. Therefore, the metabolism of skin can be activated, and further a massage effect can be expected due to the removal of fat on the skin surface, the promotion of hair growth and the stimulation to nerves.

Further, when ozone, detergent, polishing agent or the like is supplied to the air suction path, the cleaning power can be further improved.

Further, the descriptions provided above are directed mainly to shower heads for household use; however the present invention can be applied to shower heads for industrial use.

Furthermore, when the Venturi mechanism 60 of FIG. 9 is used in place of the ejector mechanism of the other shower heads shown in FIGS. 1 to 8, FIG. 10 and FIG. 11, the same advantage can be obtained.

In addition to the above, naturally, the present invention can be remodeled into various versions as long as the essence of the invention remains. Lastly, the present invention can be applied to a bath bubble-jet.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A shower head comprising:

a shower head main body having one or a plurality of Venturi mechanisms for generating a negative pressure with pressurized water supplied, a discharge outlet of said one or plurality of Venturi mechanisms opening to a shower discharge portion;

an air absorption path for communicating a throat portion of said one or plurality of Venturi mechanisms with atmosphere; and an annular projecting member projecting from the shower discharge portion so as to surround the discharge outlets, wherein an air absorption hole of the air absorption path is located outside a space defined within the annular projecting member.

2. A shower head according to claim 1, wherein the annular projecting member is provided with a path for discarding air-liquid mixed fluid.

3. A shower head according to claim 1, wherein the annular projecting member is made of a water-permeating material.

4. A shower head according to claim 1, wherein the annular projecting member is designed to be brush-like.

5. A shower head according to claim 1, further comprising, pressurized water jet holes having small diameters are made in the shower discharge portion, and a pressurized water path capable of supplying pressurized water to both the water jet holes and the jet nozzle.

6. A shower head according to claim 5, further comprising a pressurized water supply path switching mechanism in the shower head main body capable of communicating the pressurized water supply path with both or either one of the jet nozzle and the pressurized water jet holes.

7. A shower head comprising:

nozzle provided at a distal end of a shower head main body to which pressurized water is supplied, for jetting out the pressurized water;

an air absorption portion having a space section located on an exit side of the jet nozzle, for suctioning air from outside the space section;

an air-liquid mixing tube for discharging the pressurized water and the air while mixing them together;

an annular projecting member provided on a discharge outlet side of the air-liquid mixing tube, so as to surround the discharge outlet;

a second fluid suction portion having a second space section situated on the discharge outlet side of the air-liquid mixing tube, for suctioning a second fluid from outside into the second space section;

a second air-liquid mixing tube for discharging the pressurized water and the air while mixing them together;

an air absorption hole of the air absorption portion located outside a space defined within the annular projecting member; and a fluid suction hole of the second fluid suction portion located inside the space defined within the annular projecting member, wherein the pressurized water is supplied to the jet nozzle when an edge of an end of the annular projecting member is brought into contact with an object to be washed.

8. A shower head comprising:

a jet nozzle provided at a distal end of a shower head main body to which pressurized water is supplied, for jetting out the pressurized water;

an air absorption portion having a space section located on an exit side of the jet nozzle, for suctioning air from outside into the space section;

an air-liquid mixing tube for discharging the pressurized water and the air while mixing them together;

an annular projecting member provided on a discharge outlet side of the air-liquid mixing tube, so as to surround the discharge outlet;

a second fluid suction portion having a second space section situated on the discharge outlet side of the air-liquid mixing tube, for suctioning a second fluid from outside into the second space section;

a second air-liquid mixing tube for discharging the pressurized water and the air while mixing them together;

an air absorption hole of the air absorption portion located outside a space defined within the annular projecting member; and a fluid suction hole of the second fluid suction member located inside the space defined within the annular projecting member.

9. A shower head comprising:

a jet nozzle for jetting pressurized water;

a shower head main body having one or a plurality of ejector mechanisms each comprising the jet nozzle and an air-liquid mixing tube provided via an air absorption member;

a discharge outlet of the air-liquid mixing tube opening to a shower discharge member;

an annular projecting member projecting from the shower discharge member so as to surround the discharge outlet;

an outside air communication hole passing through the annular projecting member; and an air absorption hole of the air absorption member located within a space defined within the annular projecting member.

10. A shower head comprising:

a jet nozzle for jetting pressurized water;

a shower head main body having one or a plurality of ejector mechanisms each comprising the jet nozzle and an air-liquid mixing tube provided via an air absorption member;

a discharge outlet of the air-liquid mixing tube opening to a shower discharge member;

an annular projecting member projecting from the shower discharge member so as to surround the discharge outlet, the annular projecting member made of a water-permeating material; and an air absorption hole of the air absorption member located within a space defined within the annular projecting member.

11. A shower head comprising:

a jet nozzle for jetting pressurized water;

a shower head main body having one or a plurality of ejector mechanisms each comprising the jet nozzle and an air-liquid mixing tube provided via an air absorption member;

a discharge outlet of the air-liquid mixing tube opening to a shower discharge member;

an annular projecting member projecting from the shower discharge member so as to surround the discharge outlet, the annular projecting member being brush-like; and an air absorption hole of the air absorption member located within a space defined within the annular projecting member.

12. A shower head comprising:

a jet nozzle for jetting pressurized water;

a shower head main body having one or a plurality of ejector mechanisms each comprising the jet nozzle and an air-liquid mixing tube provided via an air absorption member;

a discharge outlet of the air-liquid mixing tube opening to a shower discharge member;

an annular projecting member projecting from the shower discharge member so as to surround the discharge outlet;

pressurized water jet holes having small diameters passing through the shower discharge member;

a pressurized water supply path capable of supplying pressurized water to both the pressurized water jet holes and the jet nozzle; and an air absorption hole of the air absorption member located within a space defined within the annular projecting member.

13. A shower head according to claim 12, further comprising a pressurized water supply path switching mechanism in the shower main body capable of communicating the pressurized water supply path with both or either one of the jet nozzle and the pressurized water jet holes.

* * * * *

UNITED STATES PATENT AND TRADEMARK OFFICE

CERTIFICATE OF CORRECTION

PATENT NO. : 6,267,305 B1
DATED : July 31, 2001
INVENTOR(S) : K. Kondo

It is certified that error appears in the above-identified patent and that said Letters Patent is hereby corrected as shown below:

Column 9,
Line 58, "outlets," should read -- outlet, --

Column 10,
Line 16, "nozzle" should read -- a jet nozzle --

Signed and Sealed this

Twenty-fifth Day of June, 2002

*Attest:*

*Attesting Officer*

JAMES E. ROGAN
*Director of the United States Patent and Trademark Office*